US007862891B2

(12) United States Patent
Hanna et al.

(10) Patent No.: US 7,862,891 B2
(45) Date of Patent: Jan. 4, 2011

(54) COMPOSITE TETHER AND METHODS FOR MANUFACTURING, TRANSPORTING, AND INSTALLING SAME

(75) Inventors: Shaddy Y. Hanna, Houston, TX (US); Mamdouh M. Salama, Ponca City, TX (US)

(73) Assignee: ConocoPhillips Company, Houston, TX (US)

( * ) Notice: Subject to any disclaimer, the term of this patent is extended or adjusted under 35 U.S.C. 154(b) by 94 days.

(21) Appl. No.: 11/836,360

(22) Filed: Aug. 9, 2007

(65) Prior Publication Data

US 2007/0271897 A1 Nov. 29, 2007

Related U.S. Application Data

(62) Division of application No. 10/131,658, filed on Apr. 24, 2002, now abandoned.

(60) Provisional application No. 60/287,191, filed on Apr. 27, 2001.

(51) Int. Cl.
*B32B 15/00* (2006.01)
*D02G 3/02* (2006.01)

(52) U.S. Cl. ..... 428/378; 428/375; 428/377; 428/369; 428/370; 57/210; 57/231; 57/232

(58) Field of Classification Search ..... None
See application file for complete search history.

(56) References Cited

U.S. PATENT DOCUMENTS 2,425,883 A 8/1947 Jackson
3,512,367 A 5/1970 McLallen, Jr.
3,533,870 A * 10/1970 McKee, Jr. et al. ..... 156/180
3,565,127 A * 2/1971 Nicely et al. ..... 139/426 R
4,420,276 A 12/1983 Roberts
4,432,671 A 2/1984 Westra et al.
4,589,801 A 5/1986 Salama
4,620,401 A 11/1986 L'Esperance et al.

(Continued)

FOREIGN PATENT DOCUMENTS

CA 1196200 11/1985

(Continued)

OTHER PUBLICATIONS

D.M. Miller, I. Frazer, and P. Brevig, "The Heidrun Field—Marine Operations," May 6-9, 1996, pp. 689-717, Offshore Technology Conference.

(Continued)

*Primary Examiner*—Jill Gray

(57) ABSTRACT

The present invention includes a nontwisted composite tether comprising one or more composite rods encased in a jacket and a method for manufacturing same. A portion of the rods may be bundled into one or more strands, provided however that the rods comprising the strands are not twisted into twisted strands in the assembled nontwisted tether. Such untwisted strands, if any, additionally are not twisted relative to each other. Temporary and/or permanent buoyancy may be to the tether. The present invention includes methods for preparing, transporting, and installing a composite tether on a floating platform. The tether, preferably assembled at a waterfront, is launched into the water and towed to an offshore installation site, where the tether is upended and connected via a bottom end connector on the tether to an anchor foundation in the seabed and connected a top end connector on the tether to the floating platform.

15 Claims, 5 Drawing Sheets

U.S. PATENT DOCUMENTS

| | | | | |
|---|---|---|---|---|
| 4,768,455 | A | 9/1988 | Maxson et al. | |
| 4,938,632 | A | 7/1990 | Eie | |
| 4,958,805 | A | 9/1990 | Willamsson | |
| 4,990,030 | A | 2/1991 | Salama et al. | |
| 5,080,175 | A | 1/1992 | Williams | |
| 5,092,713 | A | 3/1992 | Salama | |
| 5,174,687 | A | 12/1992 | Dunlop et al. | |
| 5,234,058 | A | 8/1993 | Sas-Jaworsky et al. | |
| 5,601,892 | A | 2/1997 | McIntosh | |
| 5,721,036 | A | 2/1998 | Tingley | |
| 5,756,206 | A | 5/1998 | Davies et al. | |
| 5,881,843 | A | 3/1999 | O'Donnell et al. | |
| 6,164,053 | A | 12/2000 | O'Donnell et al. | |
| 6,385,928 | B1 | 5/2002 | Paulshus et al. | |
| 6,397,574 | B1 | 6/2002 | De Angelis | |
| 7,137,617 | B2 * | 11/2006 | Sjostedt | 254/199 |
| 7,168,889 | B2 | 1/2007 | Hanna et al. | |
| 2003/0037529 | A1 | 2/2003 | Hanna et al. | |
| 2008/0250631 | A1 * | 10/2008 | Buckley | 29/820 |

FOREIGN PATENT DOCUMENTS

| | | |
|---|---|---|
| CA | 1210598 | 9/1986 |
| GB | 2245287 | 1/1992 |
| GB | 2363617 | 1/2002 |

OTHER PUBLICATIONS

M.R: Hornung, S.Y. Hanna, H. Hannus and D. Rowan, "The Heidrun Field—Heidrun TLP Tether System," May 6-9 1996, pp. 677-688, Offshore Technology Conference.

Mamdouh M. Salama, Ove F. Jahnsen, Per-Ola Baalerud, and Ole Lindefjeld, "Composite Carbon Fiber Tether for Deepwater TLP Applications," Oct. 1999, pp. 1-13, Deep Offshore Technology Conference.

N.W. Hein, Jr., C.J. Wall, C.D. Young, and D.E. Parks, "Materials, Welding, and Fabrication for the Jolliet Project," May 7-10, 1990, pp. 159-166, Offshore Technology Conference.

P.C. Wybro, S.C. Bultema, and J.L. Mueller, 'Installation of the Jolliet Field TLWP, May 7-10, 1990, pp. 167-180, Offshore Technology Conference.

Pascinthe Saad, Ove Jahnsen, and Mamdouh M. Salama, "Application of Composites to Deepwater Top Tensioned Riser Systems," Jun. 23-28, 2002, pp. 1-7, Offshore Mechanics and Arctic Engineering.

Communication from a related counterpart application, PCT/US02/13052, PCT International Search Report dated Apr. 24, 2003, 6 pgs.

Communication from a related counterpart application, PCT/US02/13051, PCT International Search Report dated Jul. 30, 2002, 3 pgs.

R.J. Brown, "Drilling and Production Risers Can Be Effectively Installed At a Much Lower Cost Using the Pipeliners Towing Techniques," Nov. 7-9, 2000, Deep Offshore Technology, 14 pgs.

Shaddy Y. Hanna. Mamdouh M. Salama, and Henrik Hannus, "New Tendon and Riser Technologies Improve TLP Competitiveness in Ultra-Deepwater" OTC 12963, Apr. 30-May 3, 2001, pp. 1-10, Offshore Technology Conference.

Stig Botker, Turid Storhaug, and Mamdouh M. Salama, "Composite Tethers and Risers in Deepwater Field Development: Step Change Technology," OTC 13138, Apr. 30-May 3, 2001, pp. 1-10, Offshore Technology Conference.

Office Action dated Jan. 27, 2004 for U.S. Appl. No. 10/131,658 (9 pages).

Office Action dated Mar. 2, 2004 for U.S. Appl. No. 10/131,658 (10 pages).

Office Action dated Jul. 1, 2004 for U.S. Appl. No. 10/131,658 (7 pages).

Office Action dated Sep. 21, 2004 for U.S. Appl. No. 10/131,658 (2 pages).

Office Action dated Jan. 24, 2005 for U.S. Appl. No. 10/131,658 (5 pages).

Office Action dated May 4, 2005 for U.S. Appl. No. 10/131,658 (6 pages).

Office Action dated Oct. 31, 2005 for U.S. Appl. No. 10/131,658 (9 pages).

Office Action dated Mar. 16, 2006 for U.S. Appl. No. 10/131,658 (2 pages).

Office Action dated Nov. 3, 2006 for U.S. Appl. No. 10/131,658 (8 pages).

Office Action dated Dec. 15,2006 for U.S. Appl. No. 10/131,658 (4 pages).

Office Action dated Apr. 11, 2007 for U.S. Appl. No. 10/131,658 (2 pages).

Office Action dated Jun. 6, 2007 for U.S. Appl. No. 10/131,658 (1 page).

* cited by examiner

COMPOSITE TETHER AND METHODS FOR MANUFACTURING, TRANSPORTING, AND INSTALLING SAME

CROSS-REFERENCE TO RELATED APPLICATIONS

This is a Divisional Application of U.S. patent application Ser. No. 10/131,658, filed Apr. 24, 2002 and entitled "Composite Tether and Methods for Manufacturing, Transporting, and Installing Same," which is hereby incorporated by reference herein in its entirety. As such, this application claims the benefit under 35 U.S.C. §119(e) and 37 C.F.R. §1.78(a)(4) of U.S. Provisional Patent Application No. 60/287,191, filed Apr. 27, 2001, which is also hereby incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention is a novel composite tether for use in supporting or anchoring a structure such as a floating platform or vessel, and in particular for use in anchoring a tension leg platform (TLP) to the ocean floor in deepwater and methods for manufacturing, transporting, and installing the tether. The novel composite tether is nontwisted and comprises a plurality of large diameter rods pultruded from a carbon fiber and polymer matrix composite.

BACKGROUND OF THE INVENTION

Composite tethers (also referred to as cables, tendons, support lines, mooring lines and the like) are useful for securing floating structures such as TLPs in deepwater. Particularly in depths over about 4000 feet, composite tethers offer significant economic and technical advantages and reliability over steel tethers. Composites such as carbon fibers embedded in a polymer matrix material are lightweight and have high specific strength and stiffness and excellent corrosion and fatigue resistance, which make them attractive for water depth sensitive components such as tethers and risers or umbilicals, which transport hydrocarbons from a wellhead on the ocean floor. Furthermore, composites are easily outfitted with instrumentation such as fiber optics integrated into the composite for load and integrity monitoring.

Conventional composite TLP tethers comprise top and bottom end connectors for connection to the TLP and a foundation on the ocean floor, respectively, and a tether body having a plurality of parallel twisted strands. The twisted strands herein referred to are formed from a twisted assemblage of small, parallel rods having a diameter of about 3-6 mm, and typically comprise in the range of about 50 to 200 rods per strand, wherein the assemblage of rods is subjected to a helical twist, typically about 2 to 3° on the outer rods. The plurality of parallel twisted strands, wherein each strand is typically about 50 to 75 mm in diameter, are also twisted slightly to achieve a helix in the conventional tether, also referred to herein as a twisted tether. The size of the conventional tether is determined by the number of twisted strands, which is dictated by the strength and axial stiffness requirements for a given tether service (e.g., size of the TLP, water depth, ocean currents, storm history, etc.). The number of twisted strands per conventional tether is typically from about 8 to 30 twisted strands per assembled conventional tether. Conventional tethers are twisted as described previously so that they may be wound upon tether spools, typically having a diameter of greater than about 4.0 meters, and preferably from about 4 to 8 meters. In order for the conventional composite tethers to be spoolable, small diameter rods having a diameter of no greater than about 6 mm are required, otherwise the size of the required spool becomes impractical, as described below. The spooled tethers are transported upon reel ships or barges for installation and anchoring of the TLP to the ocean floor.

The manufacturing process of a conventional, spoolable composite tether includes the following steps: fabrication of small diameter composite rods, assembly of the rods into twisted strands, assembly of the twisted tether from multiple twisted strands (including addition of filler and profile material as needed), and termination of the twisted strands in top and bottom end connectors of the tether. The manufacturing of conventional, spoolable composite tethers is described in the following conference paper, which is incorporated by reference herein in its entirety: Composite Carbon Fiber Tether for Deepwater TLP Applications, presented at the Deep Offshore Technology Conference held in Stavanger, Norway on Oct. 19-21, 1999.

Composite materials for rod manufacture consist of small diameter fibers (from about 6 to about 10 microns) of high strength and modulus, preferably carbon fibers, embedded in a polymer matrix material, e.g., resins or glues. Commonly known thermoset or thermoplastic polymeric matrices may be used. Preferred matrix materials include vinylesters and epoxies. The resin materials have bonded interfaces which capture the desirable characteristics of both the carbon fibers and the matrix. The carbon fibers carry the main load in the composite material while the matrix maintains the fibers in the preferred orientation. The matrix also acts to transfer load into the carbon fibers and protects the fibers from the surrounding environment. Carbon fibers incorporated in the matrix may be spun in long continuous lengths; however, short (from about 25 to about 100 mm) discontinuous fibers may also be used.

Composite rods are typically manufactured by pultruding the composite material comprising the carbon fibers and the polymer matrix material. Pultrusion is the pulling of the resin wetted fibers through a die rather than pushing it through the die as in extrusion processes used for metal manufacturing. The die size and shape control the final size and shape of the pultruded composite product. There are several commercial pultruders such as Glasforms, Inc., DFI Pultruded Composites Inc., Exel Oyj, Strongwell Corp., Spencer Composites Corp., and others that are capable of producing the composite rods. Rods used in conventional spoolable tethers are typically round in cross-section. The composite rods produced typically have a weight which is approximately ⅙ that of required for an equivalent steel rod. As discussed previously, rods for use in conventional composite tethers typically are from about 3 to about 6 mm in diameter and are often wound onto rod spools, for example a 1.8 or 2.2 m diameter rod spool, for transportation to a strand and/or tether manufacturing facility.

In general, it is desirable to increase the stiffness of rods used in a tether, and the stiffness of a rod may be calculated according to the following equation:

$$E \cdot A = \frac{4 \cdot \pi^2 \cdot L \cdot (\text{Vertical Mass} + \text{Added Mass})}{n \cdot T^2}$$

where E=axial stiffness of a rod (Pa); A=cross sectional area of 1 tether ($m^2$); L=water depth (m); n=number of tethers; T=heave natural periods (s), typically from about 5 to about 5.5 seconds; vertical mass=mass of the platform (kg); and added mass=mass of the water that moves when the platform moves (kg). Typically, a stiffer rod cannot be bent as much as a less stiff rod. Given that the rods typically must be wound onto a rod spool for transportation, the bending stiffness of the rod is proportional to the diameter of the rod (d) raised to the fourth power (i.e., $d^4$). Thus, it is necessary to use a small diameter composite rod (i.e., from about 3 to about 6 mm) in order for the resulting rod spool diameter to be a practical size for handling and transport and the force necessary to spool the rod and maintain it on the spool be practical. More specifically, in sizing the rod spool, the strain in the spooled rod is equal to the diameter of the composite rod divided by the diameter of the rod spool. In a properly sized spool, the rod strain is less than 50% of the ultimate strain to failure of the rod. Thus, if the composite rod has 1% strain to failure, then the diameter of the rod spool then needs to be larger than 200 times the diameter of the rod to be able to spool the rod onto the rod spool without damaging the rod. If the composite rod has ½% strain to failure, then the diameter of the rod spool has to be larger than 400 times the diameter of the rod. The diameter of a spool refers to the hub or core (i.e., drum) of the spool. In sum, where the rod itself must be spooled (or a strand or tether incorporating the rod must be spooled, as discussed below), the diameter and/or the stiffness of the rod must be engineered accordingly.

In a conventional, spoolable composite tether, the rods are assembled into bundles to form twisted strands. The twisted strands can be manufactured using typical wire rope stranding methods. Specifically, the rods are uncoiled from the rod spools and pulled through a guide plate for bundling. When the required number of rods per strand are laid out, the guide plates are rotated to impart a slight helical twist, typically 2 to 3° on the outer rods. Twisting the strand provides sufficient coherence to the strand for handling, coiling and transportation without significantly affecting the axial strength and stiffness. The rods in the twisted strands are fixed into a position by wrapping with tape or other securing device, cut to length and spooled onto strand spools for use in the assembly of the tether body. Generally, twisted strand spools include 1.8 or 2.2 m diameter spools such as those used for rod spools.

The twisted strands are assembled to form a conventional, spoolable composite tether [5] (i.e., a twisted tether) as shown in FIG. 1. The conventional, spoolable tether [5] is made up of multiple twisted strands [15], the twisted strands being further twisted with each other to form the twisted tether [5]. It can be seen that there are a large number of composite rods [10], which are bundled together to form individual twisted strands [15]. In this particular figure, there are fifteen twisted strands [15] making up the twisted tether [5], and a typical conventional tether may include from about 8 to about 30 twisted strands. The twisted strands [15] are held in place by a profiled member [20], which fills the voids between the twisted strands [15] and also provides a means for imparting a helical twist to the plurality of twisted strands [15] (thereby forming the twisted tether [5]). The profiled member [20] is preferably made from a plastic such as polyvinylchloride (PVC) or polypropylene and may be divided into segments such as center profile [25], intermediate profile [30], and outer profile [35]. The profiled member [20] may also contain void spaces [40]. A filler material may be placed in the void space between the twisted strands [15]. Preferred filler according to this invention is foam, which is used to give the tether buoyancy as described below.

The twisted strands [15] are free to move individually in the length direction, allowing individual adjustment and hence a better distribution of axial loads. The composite rods [10] and twisted strands [15] are free to act or move independently in the twisted tether [5]. In other words, there is relative axial movement between adjacent composite rods [10] within a twisted strand [15] and between adjacent composite twisted strands [15] within a twisted tether [5]. Otherwise the entire diameter of the conventional, spoolable tether [5] must be considered in calculating the diameter of the tether spool, since strain relates to the diameter of the body that is being spooled divided by the diameter of the spool, as described previously. By putting a twist in the composite rods [10] (via twisted strands [15] and twisted tether [5]) and keeping them separate and independent, the diameter of the individual composite rods [10] can roughly be used to calculate the diameter of the tether spool rather than the entire diameter of the twisted tether [5]. Typically, however, the tether spool is made somewhat larger to account for the friction between adjacent composite rods [10] as the conventional tether is spooled onto the tether spool.

As shown in FIG. 2, different size twisted strands [16] and [17] may be used to better fit all the twisted strands [16] and [17] inside an outer jacket or casing [45]. Preferably, the area within the casing [45] is filled by twisted strands [16] and [17] and empty void spaces are minimized. The twisted strands [16] and [17] are typically at least 30% of the area of the conventional, spoolable tether [5] and more typically 50% of the area of the tether [5]. Typically, the profiled member [20] and any filler material do not add any performance characteristics to the twisted tether [5], and thus it is desirable to minimize such components as much as possible to avoid unwanted additional weight and increased size.

The assembly of the conventional, spoolable tether [5] is performed using a conventional umbilical closing machine. Spools containing the twisted strands [15] and the profiled members [20] are lifted onto the closing machine. The twisted strands [15] and the profiled members [20] are then pulled through closing plates. During this process, the machine rotates to impart a helical twist in the twisted strands [15] to form the twisted tether [5]. A yarn or other securing device is then applied to hold the assembly together prior to extrusion of the protective, outer jacket [45] such as high density polyethylene (HDPE), nylon, or the like over the twisted strands to hold the twisted strands in place and protect the tether during handling. Conventional, spoolable tethers may be manufactured as a single continuous body that is spooled onto a spool. Alternatively, the tether body may be manufactured as a plurality of body lengths or segments that are spooled onto a spool. The segments are connected with connectors (e.g., couples or collars) to create a continuous tether. Segmenting the tether is helpful in accommodating production of rods, strands, and tethers, in limiting spool size, and in readjusting tether length for re-installations.

The final step of manufacturing a conventional, spoolable composite tether is the termination process that includes connecting the twisted tether to top and bottom end connectors. Termination using resin-potted cones has been extensively used in the wire rope industry. Resin terminations have been proven to be successful for terminating composite twisted strands as well. The twisted strands are fastened to a steel end connector using a potted cone technique similar to that used for termination of steel wires. The twisted strands are spread with a specific angle in the steel cones, and the cone is then filled with epoxy resin. A vacuum injection method is used in this process to avoid air gaps and to ensure consistent molding. Use of a flexible cone and cylindrical metal connector with spacers can minimize the effect of termination bending and provide better rod distribution inside the end connector. Alternatively, the twisted strands may be individually terminated and then assembled into a tether. After termination, the tether is spooled onto an appropriately sized conventional tether spool having a drum diameter of from about 4 to 8 m and a width of about 5 m, for transportation and installation offshore. An appropriately sized tether spool should be selected based upon the characteristics of the composite rods as described previously.

When conventional tethers are spooled, the inside rods comprising the twisted strands (and the inside twisted strands comprising the twisted tether) are spooled at a smaller diameter than the outside rods comprising the twisted strands (and the outside twisted strands comprising the twisted tether), thereby affecting the positioning of the rods (and twisted strands) within the conventional tether and the compression and strain forces acting thereon. Twisting the individual strands (i.e., twisted strands) and the conventional tether itself (i.e., twisted tether) subject the rods comprising the twisted strands and the twisted strands comprising the twisted tether to an effective "average diameter," meaning that no individual rod or twisted strand is always on the inside or outside of the spool. Thus, all of the rods comprising the twisted strands and the twisted strands comprising the twisted tether maintain relative position to one another and experience about the same forces while on the spool.

A number of problems exist with conventional, spoolable composite tethers. Attempts to maximize the tether stiffness are limited by the requirement that the rod diameter and/or stiffness be engineered such that the rods (as well as the resultant twisted strands and twisted tether) may be spooled without damage to the rods. Spoolable tethers incorporating a large number of rods are more difficult to manufacture and handle, and result in larger diameter tethers that are more susceptible to adverse affects from wave action such as fatigue and possible failure over time. Rod strands typically result in more undesirable void space within the tether since the strands often cannot be tightly spaced, further requiring more filler material and/or profiled members that add undesirable weight and increase size. The required twist in the twisted strands and in the twisted tether to facilitate spooling also adds to the difficulty and cost of manufacture and reduces the axial stiffness of the spoolable tether, thus requiring a larger number of rods to compensate for the stiffness loss. Expensive reel ships are required for transport and installation of spoolable tethers on TLPs. The novel composite tether of the present invention solves these various problems.

SUMMARY OF THE INVENTION

The present invention includes a nontwisted composite tether, a method for manufacturing the nontwisted composite tether, a method for installing a composite tether on a TLP, and methods for transporting a composite tether and preparing for such.

The nontwisted composite tether comprises one or more composite rods encased in a jacket. A portion of the rods may be bundled into one or more strands, provided however that the rods comprising the strands are not twisted into twisted strands in the assembled nontwisted tether. Such strands within the nontwisted tether, if any, are untwisted, and such untwisted strands additionally are not twisted relative to each other. In an embodiment, rods for use in nontwisted tethers comprise medium modulus carbon fibers (from about 32 to about 35 msi) and have a circular cross section with a diameter of greater than about 5 mm, preferably about 9 to about 25 mm, and more preferably about 12 mm. In another embodiment, rods for use in nontwisted tethers comprise high modulus carbon fibers (from about 55 to about 80 msi) and have a circular cross section with a diameter of less than about 10 mm, preferably about 3 to about 9 mm, and more preferably about 5 mm. The nontwisted tethers typically comprise from about 20 to about 1000 total rods, preferably from about 30 to about 200 total rods, and more preferably from about 30 to 80 total rods. Additional embodiments include nontwisted tethers wherein the total number of rods is less than about 30; wherein the total number of rods is less than about 10; and wherein the tether comprises a single rod. The nontwisted tether may further comprise buoyant material added temporarily or permanently inside and/or outside the jacket to increase the buoyancy of the nontwisted tether (preferably such that the nontwisted tether is neutral or positively buoyant). The nontwisted tethers may further comprise end connectors for connecting to the TLP and an anchoring foundation on the ocean floor, and the nontwisted tethers may be sized to a predetermined length and segmented into connectable segments for further ease of handling and transport.

The method for manufacturing the nontwisted composite tether comprises supplying one or more composite rods, arranging the rods axially, and encasing the rods within a jacket such that the resulting tether is nontwisted. The rods may be supplied on a spool or pultruded directly at a manufacturing site, preferably located at a waterfront. The rods may be supplied as temporarily twisted strands on spools, provided the strands are allowed to untwist prior to final assembly into the nontwisted tether. Buoyant material may be added temporarily or permanently inside and/or outside the jacket to increase the buoyancy of the nontwisted tether (preferably such that the nontwisted tether is neutral or positively buoyant). End connectors for connecting to a TLP and an anchoring foundation on the ocean floor may be added, and the nontwisted tethers may be sized to a predetermined length and segmented into connectable segments for further ease of handling and transport.

The method for installing a composite tether on a floating platform comprises launching the composite tether, towing the composite tether to an offshore installation site, upending the composite tether and connecting a bottom end connector on the tether to an anchor foundation in the seabed, and connecting the top end connector on the tether to the floating platform. In an embodiment, the installation process further comprises increasing the draft of the floating platform prior to connecting the top end connector thereto and subsequently decreasing the draft after the top end connector is connected thereto such that the composite tether is placed under tension by the buoyancy of the floating platform. Preferably, the floating platform is a tension leg platform (TLP). The tether may be towed at the surface or below the surface to the installation site and may be anchored offshore for storage before or after towing.

The method for transporting a composite tether over a body of water comprises launching the tether into the body of water and towing the tether to an offshore installation site. The tether may be towed on or below the surface of the water, and preferably is a nontwisted tether.

The method for preparing a composite tether for transportation comprises adding buoyant material to the composite tether and launching the buoyant composite tether into a body of water. The buoyant material may be added during manufacture of the tether, after manufacture, or both. The tether, preferably a nontwisted tether, may be anchored offshore for storage before or after towing.

DETAILED DESCRIPTION OF THE INVENTION

Figure 1:
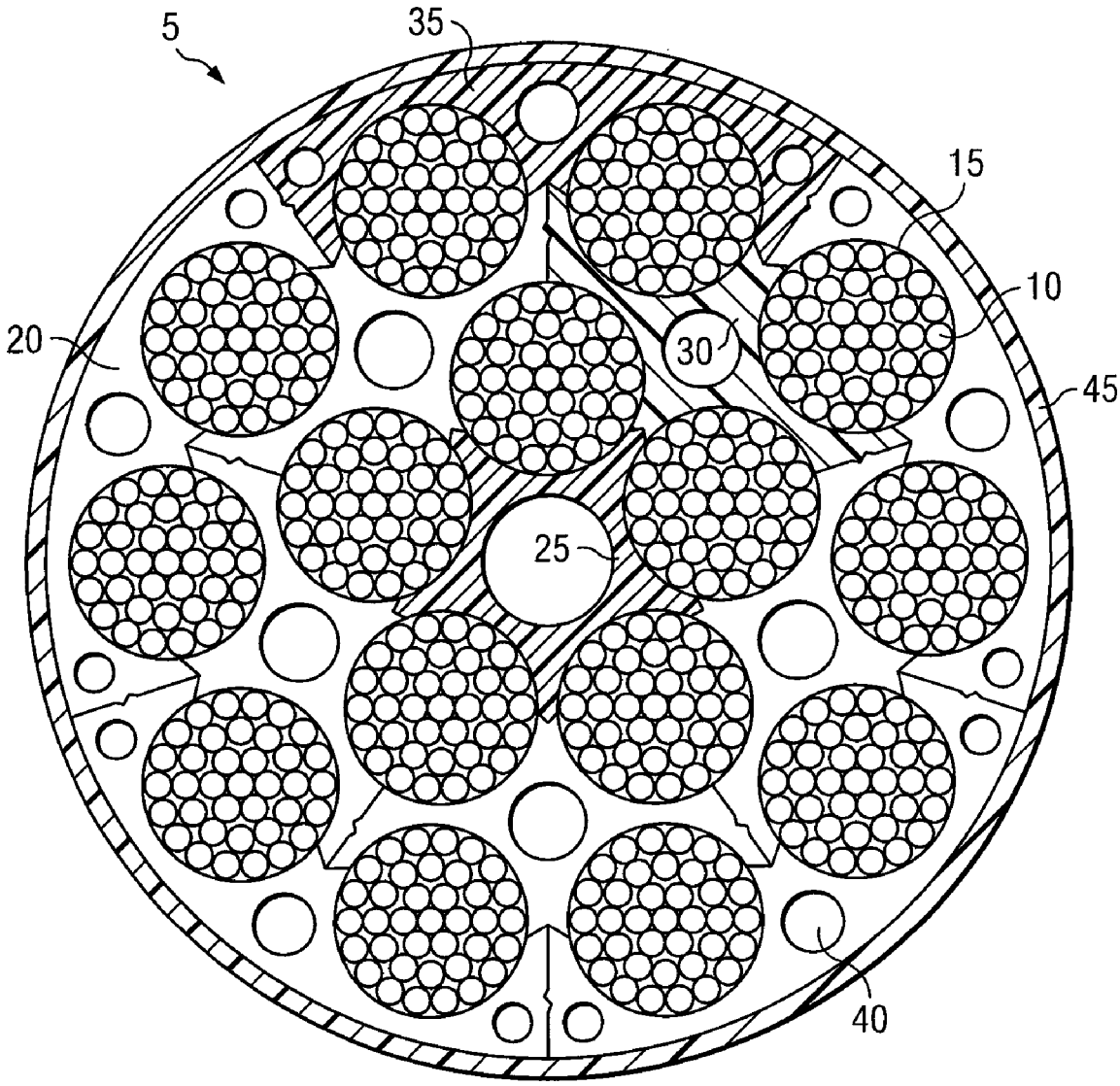
FIG. 1 (PRIOR ART)
FIG. 1 is a cross-sectional view of a conventional, spoolable composite tether having same sized strands of rods.
Figure 2:
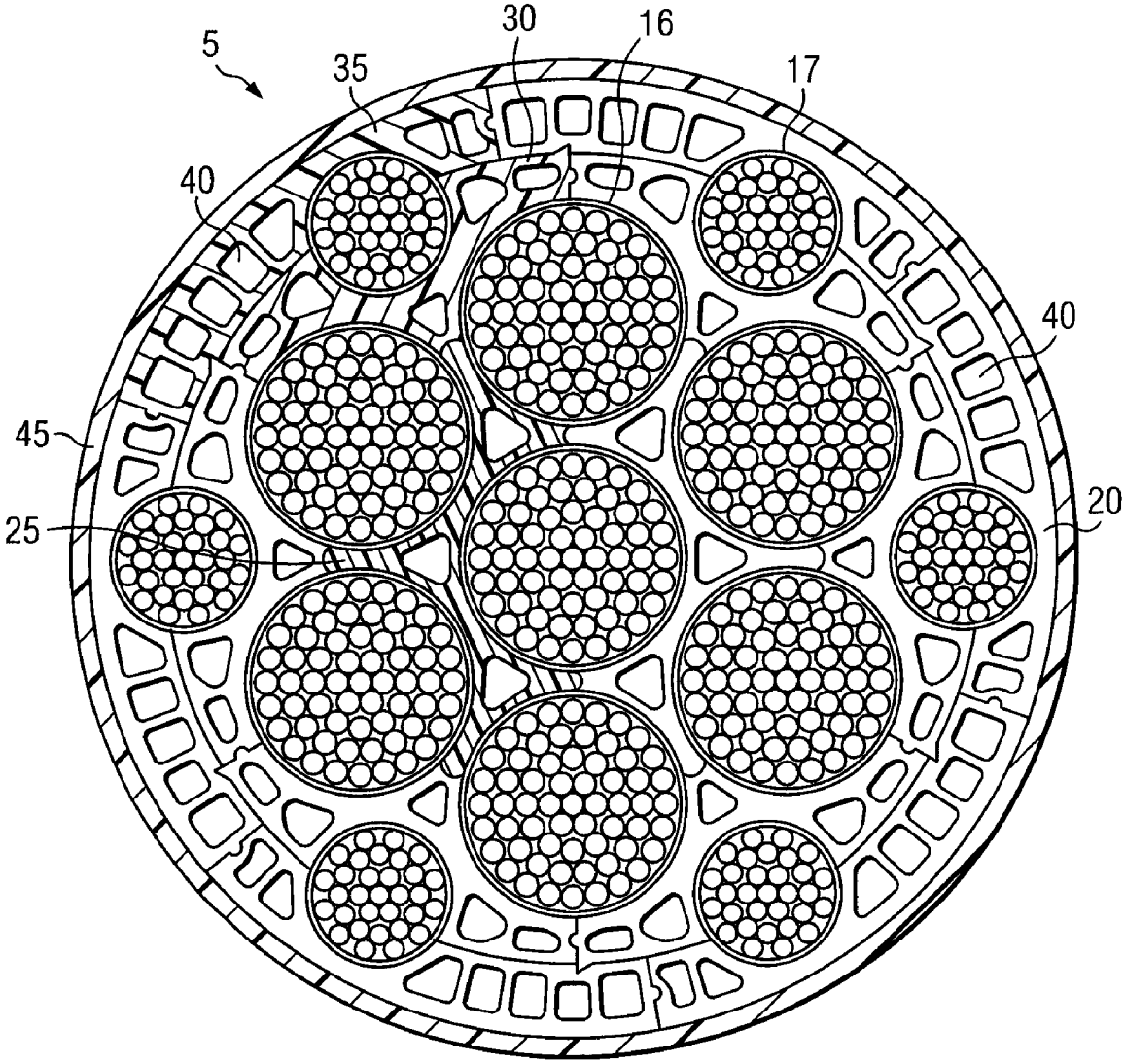
FIG. 2 (PRIOR ART)
FIG. 2 is a cross-sectional view of a conventional, spoolable composite tether having differing sized strands of rods.

The novel composite tethers according to the present invention are nontwisted as compared to conventional, twisted composite tethers. The nontwisted composite tether comprises one or more composite rods encased in a jacket, and typically comprises a plurality of composite rods encased within the jacket. Within the nontwisted tether, the rods are arranged in parallel, axial alignment and are not subjected to twist either individually or relative to one another. More specifically, the rods may be placed in bundles or strands within the nontwisted tether, but the bundles or strands are not subjected to helical twisting to form twisted strands. Furthermore, bundles or strands within the nontwisted tether are not subjected to twist relative to one another (i.e., are not twisted into a twisted tether, as described previously). Typically, the nontwisted composite tethers of the present invention, upon assembly, are not capable of being spooled onto spools as described previously for conventional tethers.

Rods for use in nontwisted tethers may be made of the same or similar materials (e.g., carbon fibers in a polymer matrix) and by the same or similar methods (e.g., pultrusion) as rods for use in conventional, spoolable tethers, as described previously. Rods for use in nontwisted tethers preferably (but not necessarily) have a relatively larger diameter as compared to the 3 to 6 mm spoolable rods described previously in a conventional, spoolable tether. The cross-sectional area of individual rods for use in nontwisted tethers is preferably greater than about 28 $mm^2$. Rods for use in nontwisted tethers typically (but not necessarily) are not capable of being spooled onto spools as described previously for spoolable rods used in conventional, spoolable tethers. Provided that the rods are spoolable, the rods may be spooled onto rod spools for transportation to the manufacturing site of the composite nontwisted tether. If the rods are not spoolable (due to size, stiffness, cross-sectional shape, composite composition, or combinations thereof), then the larger rods are preferably manufactured at the nontwisted tether manufacturing site, which ideally is located near a waterfront as discussed below. A portion of the rods may be bundled into one or more strands, provided however that the rods comprising the strands are not twisted into twisted strands in the assembled nontwisted tether. In sum, strands within the nontwisted tether, if any, are untwisted, and such untwisted strands additionally are not twisted relative to each other.

Rods for use in nontwisted tethers preferably (but not necessarily) comprise medium or high modulus carbon fibers. Preferred low cost, medium modulus (from about 32 msi to about 35 msi, and preferably about 33 msi) carbon fibers are polyacrylonitrile (PAN) carbon fibers such as those available from Grafil Inc., Toray Industries, Inc., Akzo Nobel, and ZOLTEK, among others. Preferred low cost, high modulus (from about 55 msi to about 80 msi, and preferably 70 msi) carbon fibers are those available from Conoco Inc. and Mitsubishi Corp.

In an embodiment, rods for use in nontwisted tethers comprise medium modulus carbon fibers and have a circular cross section with a diameter of greater than about 5 mm, preferably about 9 to about 25 mm, and more preferably about 12 mm. In another embodiment, rods for use in nontwisted tethers comprise high modulus carbon fibers and have a circular cross section with a diameter of less than about 10 mm, preferably about 3 to about 9 mm, and more preferably about 5 mm.

Typically, nontwisted tethers of the present invention comprise a total number of rods that is less than the total number of rods in a conventional, spoolable tether, the total number of rods being based upon the required stiffness of the tether, as described previously. The nontwisted tethers typically comprise from about 20 to about 1000 total rods, preferably from about 30 to about 200 total rods, and more preferably from about 30 to 80 total rods. Additional embodiments include nontwisted tethers wherein the total number of rods is less than about 30; wherein the total number of rods less than about 10; and wherein the tether comprises a single rod.

The cross-section of the rods may have any suitable shape, including irregular. Preferred rod cross-sectional shapes include those which allows adjacent rods to closely fit against one another such as round and polygonal (e.g., hexagonal, octagonal, square, triangular, and rectangular), thereby minimizing the void space between rods. Likewise, the nontwisted tether itself, as well as any strands therein, may have a wide variety of cross-sectional shapes in comparison to conventional, spoolable tethers that are almost exclusively circular. Close fitting rods provide for a much more compact tether which is less susceptible to wave action and eliminates or minimizes filler material and profiled members, thereby reducing the weight of the tether. The rods may be solid or hollow, that is having at least one cross-section with a hole or aperture in it. Hollow rods are preferably open at either end and hollow across their entire length like a tube or pipe. To account for water pressure, hollow rods preferably have hoop wind or the bores thereof are filled with a support material such as foam.

Referring to FIGS. 4A-D, in producing the nontwisted tether [85] of the present invention, a plurality of rods [55] are supplied, for example from rod spools [60]. Alternatively, the rods [55], and in particular rods that are nonspoolable due to size, stiffness, cross-sectional shape, composite composition, or combinations thereof, can be produced on-site with protrusion equipment (not shown) installed at the tether manufacturing site. The individual rods [55] are bundled together to form rod bundle [67], which can be facilitated by passing them through a template [65] having holes to guide each of the rods [55] together. In contrast to manufacture of a conventional, spoolable tether, the template [65] is not rotated to impart a helical twist in the tether (i.e., a twisted tether). A cross-sectional view taken along line A-A of the rod bundle [67] is indicated by reference numeral [75]. Alternatively, the rods may be placed in untwisted strands as described previously. Such strands may be assembled at a remote location and transported to the manufacturing site on spools, in which case the strands may be temporarily twisted into twisted strand for spooling and transport, but allowed to untwist prior to integration into the nontwisted tether. The individual rods [55] may be laid upon soft supports or rollers [70] spaced to prevent unacceptable deflections and abrasion in the rods. The rods [55] may be added to the bundle [67] individually or simultaneously and held in place using temporary means such as tape or yarn. A protective jacket [80], for example polyethylene, nylon, or the like, is extruded over the rod bundle [67] using a jacket machine [86] to form the nontwisted tether [85]. The nontwisted tether [85] is terminated by cutting the tether to length and adding end connectors [90] and [95].

As described in detail below, nontwisted tethers of the present invention, and in particular those designed and configured for service in anchoring a TLP to the ocean floor, may further comprise buoyant material added temporarily or permanently to increase the buoyancy of the nontwisted tether (preferably such that the nontwisted tether is neutral or positively buoyant). The nontwisted tethers may further comprise end connectors for connecting to the TLP and an anchoring foundation on the ocean floor, and the tethers may be segmented into connectable segments for further ease of handling and transport.

Figure 3A:
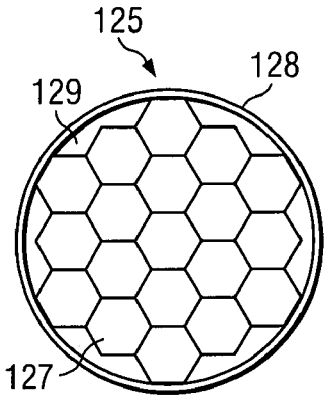
FIGS. 3A-G are cross-sectional views of nontwisted tethers according to the present invention.
Figure 3B:
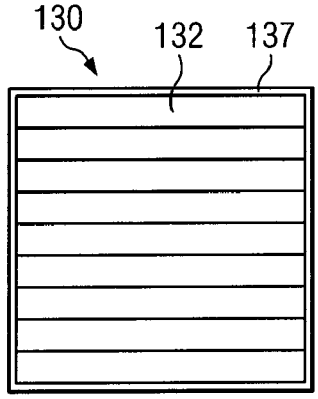
Figure 3C:
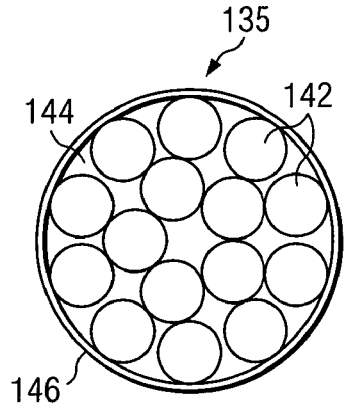
Figure 3D:
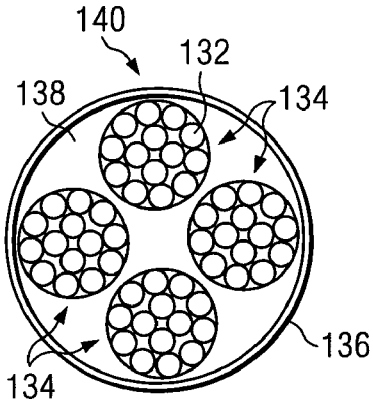
Figure 3E:
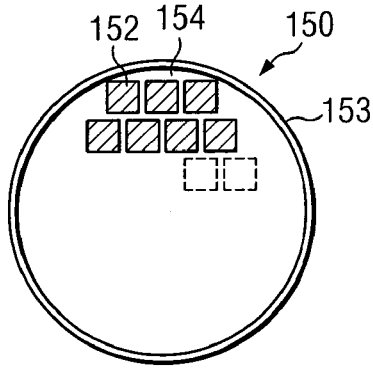
Figure 3F:
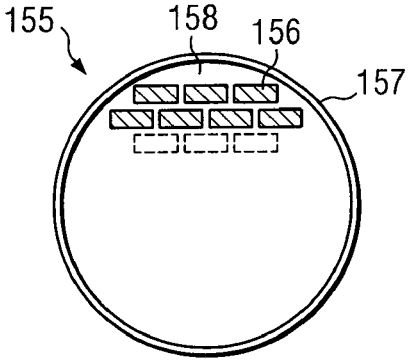
Figure 3G:
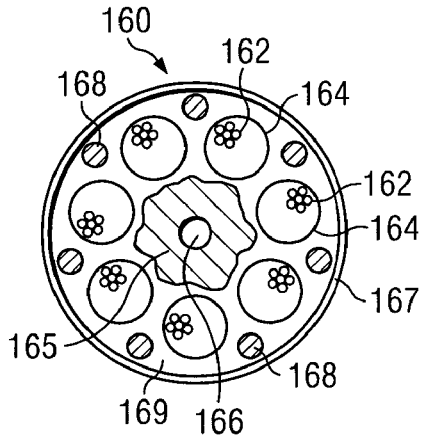

Examples of cross-sections for nontwisted tethers of the present invention are shown in FIGS. 3A-G, such examples being a small sample of the many possible combinations and are not to be construed as limiting the available combinations. Preferred configurations are shown in FIGS. 3A and 3D. In an embodiment employing high-modulus, discontinuous carbon fibers, a preferred configuration is shown in FIG. 3B. Referring to FIG. 3A, a nontwisted tether [125] comprises a plurality of solid hexagonal rods [127] arranged in an abutting, close fitting relationship and protected within a jacket [128]. A filler material [129] (and/or a profiled member as described previously) fills the space between outer surfaces of the rods [127] and the inner surface of the jacket [128]. Referring to FIG. 3B, a nontwisted tether [130] has a square cross section and comprises a plurality of stacked, rectangular solid rods [132] protected within a jacket [137]. Given the close fitting relationship between the rectangular rods [132] and the jacket [137], no filler material or profiled member is required in nontwisted tether [130]. Referring to FIG. 3C, a nontwisted tether [135] comprises a plurality of solid circular rods [142] that are not bundled into strands. Nontwisted tether [135] is protected within a jacket [146], and a filler material [144] (and/or a profiled member) fills the space between the outer surface of the rods [142] and the inner surface of the jacket [146]. Referring to FIG. 3D, a nontwisted tether [140] comprises a plurality of solid circular rods [132] bundled into strands [134], which are not twisted. The strands [134] are protected within a jacket [136], and a filler material [138] (and/or a profiled member) fills the space between the outer surface of the strands [134] and the inner surface of the jacket [136]. Referring to FIG. 3E, a nontwisted tether [150] comprises a plurality of solid square rods [152] arranged in an abutting, close fitting relationship (shown in partial fill for clarity) and protected within a jacket [153]. A filler material [154] (and/or a profiled member) fills the space between outer surfaces of the rods [152] and the inner surface of the jacket [153]. Referring to FIG. 3F, a nontwisted tether [155] comprises a plurality of solid rectangular rods [156] arranged in an abutting, close fitting relationship (shown in partial fill for clarity) and protected within a jacket [157]. A filler material [158] (and/or a profiled member) fills the space between outer surfaces of the rods [156] and the inner surface of the jacket [157]. Referring to FIG. 3G, a nontwisted tether [160] comprises a plurality of small, solid circular rods [162] (shown in partial fill for clarity) bundled into strands [164], which are not twisted. The strands [164] surround a centrally positioned, large irregularly shaped rod [165] having a bore [166], indicating that the hexagonal rod is hollow. The nontwisted tether [160] further comprises a plurality of medium circular rods [168] positioned along the inner circumference of the tether. The nontwisted tether [160] is protected by a jacket [167], and void space within the tether is filled with a filler material [169] (and/or a profiled member).

Figure 5:
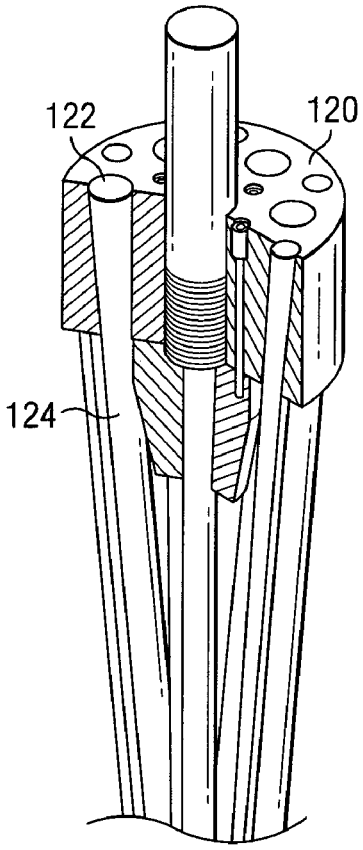
FIGS. 5 and 6 are cross-sectional views of tether terminations.
Figure 6:
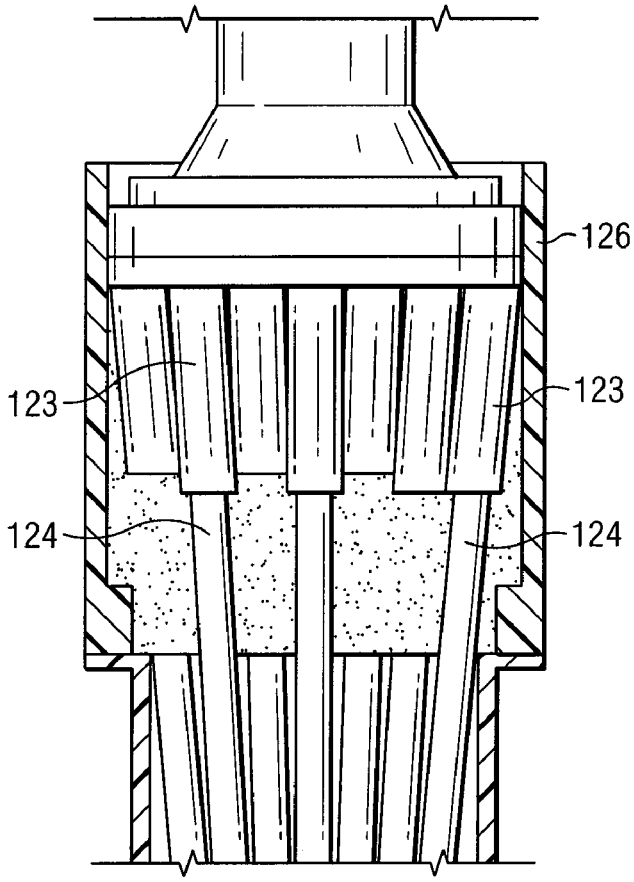

The termination used for the addition of end connectors [90] and [95] on the nontwisted tether [85] is similar to that used for a steel tether (e.g., a potted termination). Referring to FIG. 5, a metal cone [120] receives the ends [122] of the composite rods [124] and the cone is filled with a resin system, as for example, an epoxy system. Alternatively as shown in FIG. 6, with larger diameter composite rods (or strands of rods) used in the tether, each of the individual rods (or strands of rods) [124] can be terminated separately, which should produce a stronger connection. A metal sleeve [123] is bonded to (with epoxy or other resin system) and protrudes from the end of each individual larger diameter composite rods (or strands of rods) [124] and the ends of these metal sleeves [123] then are attached together such as by putting the ends of the metal sleeves [123] into an end connector [126].

The nontwisted tether [85] may be further segmented into two or more connectable segments (not shown) for ease of handling, the segments having connector means such that the segments are capable of being reconnected prior to installation. Buoyant material may be temporarily and/or permanently added to the nontwisted tether [85]. Permanently attached buoyant material [105], for example foam, can be placed inside the jacket [80], for example over the bundle of rods [67] and/or into the void space there between. Another method for permanently adding buoyant material is to wrap a buoyant material such as foam around a first jacket and then place a second jacket over the foam. Permanent buoyant material is preferably added during manufacture of the nontwisted tether. Any suitable type of buoyant material may be used as known to those skilled in the art, for example syntactic foam or foamed polypropylene.

Figure 4A:
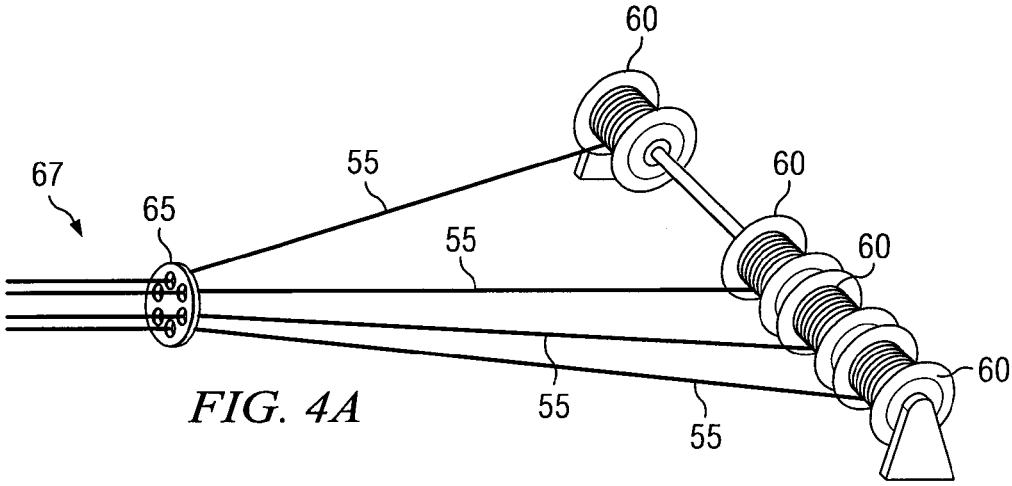
FIGS. 4A-D depict the manufacture of a nontwisted tether according to the present invention.
Figure 4B:
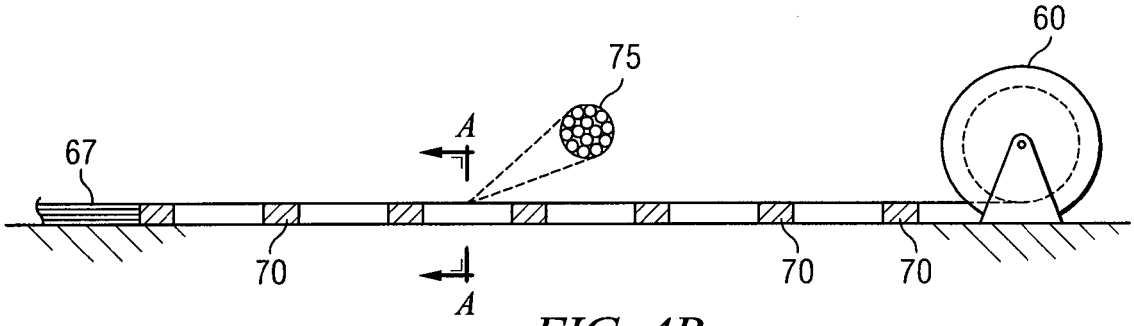
Figure 4C:
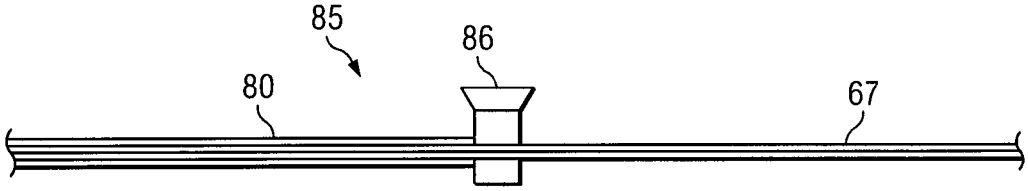
Figure 4D:
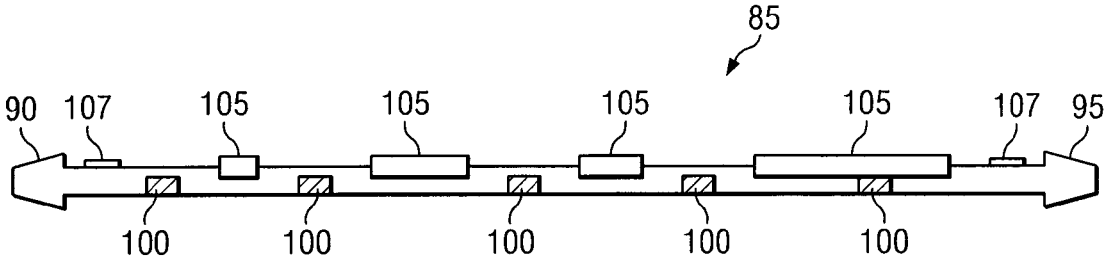

Temporarily attached buoyant material [105] can be attached to the outside of the nontwisted tether [85] and removed during or after the tether installation. Additional external temporary buoyancy modules (TBM) [107] may be required, for example after securing a nontwisted TLP tether to the foundation and before arrival of the TLP at the installation site. The nontwisted tether may include a special collar (not shown) to support the TBM, or the TBM can be supported against the top end connector as shown in FIG. 4D. TBM can be installed after upending the tether, or towable TBM can be installed on the tether body before launching. For example, towable metal or composite air cans can be pre-installed at the fabrication site to eliminate the need for offshore crane to handle and attach the TBM.

Preferably, nontwisted tethers according to the present invention, and in particular TLP tethers, are manufactured at a shoreline, waterfront, or waterside where they can be launched and towed to an installation site offshore. The terms shoreline, waterfront, and waterside are synonymous and mean in close proximity to a continuous water passage from the manufacturing site to the site where the tether is to be installed offshore, for example a stretch of beachfront or a manufacturing facility located at a dock, pier, or harbor. Preferably, the shoreline manufacturing site will have relatively unrestricted direct access to open water (in contrast to a route requiring turns or bends during navigation) to minimize the imposition of high curvatures on the nontwisted tethers during towing. The nontwisted tether may be laid out parallel, perpendicular, or at an angle to the shoreline, and may be gently looped back and forth (for example in a figure eight pattern) along a substantially horizontal surface if necessary to save space provided that the design limits of the nontwisted tether are not exceeded by bending in the loops. The nontwisted tether may be launched for example by using cranes where the nontwisted tether is positioned parallel to the shoreline or by using a winch and rollers where the nontwisted tether is positioned perpendicular or at an angle to the shoreline. The nontwisted tether may be anchored offshore for storage before or after towing. Tugs or towboats suitable for towing the launched tether are more commonly available and cheaper than the relatively rare, specialized reel ships that are used in installing conventional spooled tethers.

Buoyancy may be added or removed from the tether as needed for transportation and/or post-installation service. Typically, a nontwisted tether may or may not require additional temporary buoyancy for towing the tether to the offshore platform and/or for installation thereon. Buoyancy during towing avoids sagging and associated stresses on the tether and eases towing. The tether may be on the surface or below the surface for towing, and the buoyancy adjusted as required for the desired tow. Buoyancy during installation avoids placing an excessive load on the tether. Permanent buoyancy may be used during post-installation service to minimize the tendon weight on the floating platform. Preferably, the composite tethers are nearly neutral buoyant upon installation, hence the displacement of the TLP is constant and need not be increased to account for additional weight of a negatively buoyant tether. Thus, a composite tether can be used in extremely large depths without appreciably adding additional weight to the floating platform.

Typically, the tether is outfitted for towing prior to being placed in the water, for example with buoyancy elements to support the top and bottom end connectors; temporary, removable buoyancy elements spaced intermittently along the length of the tether, if the tether is not neutrally-buoyant; temporary, removable marker-type buoys, if the tether is neutrally buoyant; navigation lights and radar reflectors; and towing bridles forward and aft. The outfitted tethers may be stored on land and launched shortly before commencement of tow, or alternatively may be launched and moored in a sheltered location for storage before or after tow. Typically, the tethers are towed one at a time to minimize risk of loss, and three vessels are used to tow the tether: a lead tug, a trail tug, and an escort vessel to reduce the risk of other waterborne traffic hitting or riding over the tether while in tow. Towage speeds typically range between about 6 to about 8 knots, depending in part upon towage distance and weather conditions.

Upon installation of adequate permanent and/or temporary buoyancy and launch of the completed nontwisted tether as described previously, the tether is towed by a tow vessel spread to the offshore site where the floating platform (e.g., TLP) is to be tethered to the ocean floor. Anchor foundations, for example a concrete foundation or suction anchor, are preset in the seabed at the installation site. Upon reaching the installation site, the nontwisted tether is disconnected from the tow vehicles, upended, and the bottom end connector connected to the preset anchor. More specifically, a support vessel having a suitable crane, ROV spread, and TBMs is stationed at the installation site. Upon arrival of the tether towing vessels, the lead tug transfers forward, top end portion of the tether to the crane on the support vessel. The trail tug remains attached via an anchor winch wire to the aft, bottom end portion of the tether. The buoyancy elements are removed from the bottom end portion of the tether, which is subsequently supported by the winch wire. To up-end the tether, the trail tug plays out the winch wire to lower the bottom end portion of the tether toward the ocean floor, and the top end portion of the tether is held on place by crane. During up-ending, other removable elements such as marker buoys and intermediate buoyancy elements are removed, for example by pull lines, acoustically activated release triggers, or automatically activated, depth-sensitive release mechanisms. When the tether reaches a substantially vertical position, the winch line is disconnected from the bottom end portion of the tether via an ROV from the support vessel. A TBM is attached to the top end portion of the tether, and the support vessel maneuvers the bottom end portion of the tether over the appropriate tether foundation receptacle located in the ocean floor, as monitored by a ROV. The bottom end connector of the tether is stabbed into the foundation and latched into position, at which time the buoyancy of the TBM is adjusted via a blowdown hose that displaces seawater in the TBM with air from a compressor on the support vessel. Once the tugs have transferred the tether to the support vessel, the towage vessel spread may return to base for towing of the next tether. The tether up-ending operations continue until all tethers are up-ended and freestanding. Typically, the support vessel remains on site during the time between completion of upending and final installation of the TLP to monitor the tethers and adjust buoyancy of the TBM as needed.

Before connecting the top end connector of the tether to the TLP, a constant tension winch is connected to tether and is activated in combination with the addition of ballast to cause the TLP to sink lower in the water (i.e., increase the draft of the TLP). The top end connector of the tether is connected to the TLP, and the draft is reduced through deballasting until the correct draft and tension on the tethers are maintained. Typically, a plurality of tethers are installed to hold the floating platform securely in position. Installation of the composite tether via towing and upending is similar to towing and upending steel tethers, as discussed in the following articles each of which is incorporated by reference herein in its entirety: Drilling and Production Risers Can be Effectively Installed at a Much Lower Cost Using the Piperlines Towing Techniques, presented at the Deep Offshore Technology 12$^{th}$ International Conference held in New Orleans, La. on Nov. 7-9, 2000; OTC 8100: The Heidrun Field—Heidrun TLP Tether System, presented at the Offshore Technology Conference held in Houston, Tex. on May 6-9, 1996 (p. 677-688); OTC 8101: The Heidrun Field—Marine Operations, presented at the Offshore Technology Conference held in Houston, Tex. on May 6-9, 1996 (p. 689-717); OTC 6361: Materials, Welding, and Fabrication for the Jolliet Project, presented at the Offshore Technology Conference held in Houston, Tex. on May 7-10, 1990 (p. 159-166); and OTC 6362: Installation of the Jolliet Field TLWP, presented at the Offshore Technology Conference held in Houston, Tex. on May 7-10, 1990 (p. 167-180).

While is it preferred that the preparation, transportation, and installation methods described herein be used to install nontwisted tethers of the kind described herein, such methods may also be used to install conventional composite tethers. For example, the spool containing a conventional tether may be placed near the waterside and the tether towed out therefrom and installed as described previously.

EXAMPLE

The following example is a comparison of the dimensions of a conventional, spoolable composite tether identified as round tether A with two nontwisted tethers, each of which is produced in accordance with this invention, identified as square tether NS-1 having a plurality of solid rectangular rods and round tether NS-2 having a plurality of solid circular rods.

Two important parameters for sizing a tether in response to a given load and to provide the needed stiffness are the total cross-sectional area of the composite rods in the tether and the elastic modulus of the rods. In general, if the elastic modulus of the composite rod is increased (thus increasing the stiffness of the composite), the required cross-sectional area of the composite that is carrying the load is reduced. The total cross-sectional area of the rods that is carrying the load is equal to the cross-sectional area of each rod times the number of rods. Stated alternatively, the number of rods required can be determined by dividing the total cross-sectional area of the rods required to carry a given load and achieve a specific stiffness by the cross-sectional area of each rod. From this relationship, it can be seen that for a given total cross-sectional area, use of larger rods, as is preferred according to the present invention, results in a fewer number of rods that must be produced, handled, and incorporated into the tether. The following table compares the dimensions of the three tethers where the elastic modulus of the composite and the cross-sectional area of the composite that is carrying the load are held constant:

| | Tether A | Tether NS-1 | Tether NS-2 |
|---|---|---|---|
| Rod Dimensions | 6 mm diameter | 150 mm wide and 6 mm thick | 12 mm diameter |
| Number of Rods | 781 | 24 | 195 |
| Surface Area per Rod ($mm^2$) | 28.3 | 900.0 | 113.0 |
| Total Surface Area ($mm^2$) | 22102 | 21600 | 22035 |
| Tether Dimensions (mm) | 270 diameter | 150 mm square | 177 diameter |

As can be seen form the table, the nontwisted tethers NS-1 and NS-2 of the present invention have significantly fewer total rods and are significantly smaller in overall size as compared to the conventional, spoolable composite tether A.

While preferred embodiments of the invention have been shown and described, modifications thereof can be made by one skilled in the art without departing from the spirit and teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

The invention claimed is:

1. A composite tether comprising:

a plurality of strands;

wherein the strands are not twisted with respect to each other;

wherein the strands are individually untwisted;

wherein each strand comprises a plurality of composite rods;

wherein the composite rods within each of the strands are not twisted with respect to each other;

wherein each rod is individually untwisted; and wherein at least a portion of the composite rods comprise a plurality of carbon fibers embedded in a polymer matrix.

2. The tether of claim 1 further comprising at least two connectable segments wherein the composite tether comprises two ends wherein each of the connectable segments is connected to one end of the composite tether.

3. The tether of claim 1 having a total number of rods of from about 20 to about 1000.

4. The tether of claim 1 wherein the rods comprise medium modulus carbon fibers, are circular and have a diameter greater than about 5 mm.

5. The tether of claim 4 wherein the medium modulus carbon fibers have a modulus of elasticity from about 32 to about 35 msi.

6. The tether of claim 4 wherein the high modulus carbon fibers have a modulus of elasticity from about 55 to about 80 msi.

7. The tether of claim 1 wherein the rods comprise high modulus carbon fibers, are circular and have a diameter of less than about 10 mm.

8. The tether of claim 1 wherein the cross-section of at least one rod, one strand, or the tether is rectangular, square, hexagonal, octagonal, or irregular.

9. The tether of claim 1 wherein at least one rod is hollow.

10. The tether of claim 1 further comprising buoyant material.

11. The tether of claim 10 wherein the tether is neutrally buoyant.

12. The tether of claim 10 wherein the tether is positively buoyant.

13. The tether of claim 10 wherein at least a portion of the buoyant material is temporarily attached to the tether.

14. The tether of claim 10 wherein at least a portion of the buoyant material is permanently attached to the tether.

15. The tether of claim 10 wherein at least a portion of the buoyant material is encased within a jacket.

* * * * *